US005511873A

United States Patent [19]

Mech

[11] Patent Number: 5,511,873

[45] Date of Patent: Apr. 30, 1996

[54] CABINET FOR THE STORAGE AND DISPLAY OF JEWELRY

[76] Inventor: Sharon A. Mech, 12551 W. 159th St., Lockport, Ill. 60441

[21] Appl. No.: 303,955

[22] Filed: Sep. 9, 1994

[51] Int. Cl.[6] ..... A47B 67/02; A47G 1/12; G02B 5/08

[52] U.S. Cl. ..... 312/227; 312/329; 312/246; 312/351; 312/293.2; 206/6.1; 206/566

[58] Field of Search ..... 312/227, 351, 312/246, 293.2, 329; 206/6.1, 566

[56] References Cited

U.S. PATENT DOCUMENTS

| | | | |
|---|---|---|---|
| 1,284,492 | 11/1918 | Thomas | 312/227 X |
| 1,341,106 | 5/1920 | Booth | 312/227 X |
| 1,980,730 | 11/1934 | Matchette | 312/227 X |
| 2,439,664 | 4/1948 | Marchard | 312/329 X |
| 2,629,964 | 3/1953 | Thurell | 312/351 X |
| 2,883,254 | 4/1959 | Bacca | 312/329 X |
| 2,911,275 | 11/1959 | Wise | 312/293.2 X |
| 3,321,117 | 5/1967 | Hedin | 312/329 X |
| 4,324,446 | 4/1982 | LeSage | 312/246 X |
| 4,797,516 | 11/1988 | Morrison | 206/566 |
| 5,090,784 | 2/1992 | Battista | 312/227 X |
| 5,121,833 | 6/1992 | Lindsay et al. | 206/566 X |
| 5,139,322 | 8/1992 | Aisley | 312/227 X |
| 5,141,300 | 8/1992 | Ciesla | 206/566 X |
| 5,168,986 | 12/1992 | Stenhouse | 206/6.1 |
| 5,242,048 | 9/1993 | Ellingsworth et al. | 206/6.1 |
| 5,246,103 | 9/1993 | Hicks | 206/6.1 |

*Primary Examiner*—Jose V. Chen
*Assistant Examiner*—Rodney B. White
*Attorney, Agent, or Firm*—Welsh & Katz, Ltd.

[57] ABSTRACT

A jewelry cabinet has a generally rectangular housing with a peripheral wall and a rear planar wall and a generally vertically extending middle wall which forms a left compartment and a right compartment within the housing. A left door and right door are pivotally connected to the housing and adapted to close the left compartment and right compartment respectively. A portion of the exterior of one of the doors is mirrored. On the interior of at least of the left and right doors is arranged a plurality of hanging hooks to retain necklaces.

Within at least one of the compartments is a plurality of horizontally extending shelves. The shelves have a generally horizontally extending strip for supporting jewelry with at least one of the shelves also having a frontal vertical strip forming a slot for retaining an earring. The middle wall and the vertical wall bordering the compartment are adapted to removably hold the shelves in a vertically separated arrangement.

8 Claims, 3 Drawing Sheets

CABINET FOR THE STORAGE AND DISPLAY OF JEWELRY

FIELD OF THE INVENTION

The present invention generally relates to containers for the storage and display of jewelry and more particularly to a jewelry cabinet which retains most of the different types of jewelry such that the jewelry is visible and easily accessible.

BACKGROUND OF THE INVENTION

As is well known, jewelry is one of the most prevalent fashion accessories. Many women also have numerous pieces of jewelry. In selecting jewelry to complement clothing or to make an individual fashion statement, a wearer may seek to form a certain particular combination of earrings, necklaces, bracelets, etc. Also the determination of whether a certain combination is desirable may be formed only after wearing the individual pieces and viewing the appearance of the combination.

The selection and viewing of a jewelry combination can be a very frustrating experience. All the different items of jewelry may be stored in different places. The mixing of the items of jewelry may require the retrieving of a large number of storage containers such as jewelry cases. Also the viewing of the result of a certain selection of jewelry may be burdensome. Jewelry case mirrors may be too small. Using a dresser mirror may require the placing of the jewelry storage containers within easy reach.

Also, jewelry cases may be suitable for organizing and storage of a particular kind of jewelry such as earrings but ill suited for the storage and/or display of other items such as necklaces. For example, drawer storage may be appropriate for earrings and rings but necklaces may become snarled in a drawer.

Earrings in particular pose a storage and display problem, as they come in many different styles such as post, wire, clip or hoop. Each style is sufficiently different that storage and display cases which are uniquely configured for one style of earring may be unsuitable to store and display the other styles.

It is therefore an object of the present invention to provide an improved container for the storage and display of jewelry. A related object is to provide such a container in the form of an improved jewelry cabinet for the storage of jewelry so that the jewelry is easily accessible.

A further object of the present invention is to provide an improved jewelry cabinet particularly adapted for the storage and display of the many different types of jewelry.

A still further object of the present invention is to provide an improved jewelry cabinet which facilitates the viewing of various selected combinations of items of jewelry.

Yet another object of the present invention is to provide an improved jewelry cabinet which may interchangeably store and display the many different styles of earrings.

SUMMARY OF THE INVENTION

The above objects are met or exceeded by the provided jewelry cabinet. The jewelry cabinet has a generally rectangular housing with a peripheral wall formed by a left and right generally vertically extending sidewalls connected by a top sidewall and a bottom sidewall. The housing also has a rear planar wall and a generally vertically extending middle wall which forms a left compartment and a right compartment within the housing. A left door and right door are pivotally connected to the housing and adapted to close the left compartment and right compartment respectively. A portion of the exterior of one of the doors is mirrored. On the interior of at least one of the left and right doors is arranged a plurality of hanging hooks to retain necklaces.

Within at least one of the compartments is a plurality of horizontally extending shelves. The shelves have a generally horizontally extending strip for supporting jewelry with at least one of the shelves also having a frontal vertical strip forming a slot for retaining an earring. The middle wall and the vertical wall bordering the compartment are adapted to removably hold the shelves in a vertically separated arrangement.

More particularly, the shelves may be arranged in both of the compartments with a number of the shelves including the vertical display strips. In one of the compartments, the shelves may be arranged so that a display spacing may be formed. Within the display spacing, a number of hooks for the displaying of necklaces and bracelets may be attached to the rear wall. Also a mirror may cover a portion of the interior surface of the other of the left and right doors so that the various selections of jewelry may be viewed without having to close one of the doors.

DESCRIPTION OF THE PREFERRED EMBODIMENT

Figure 1:
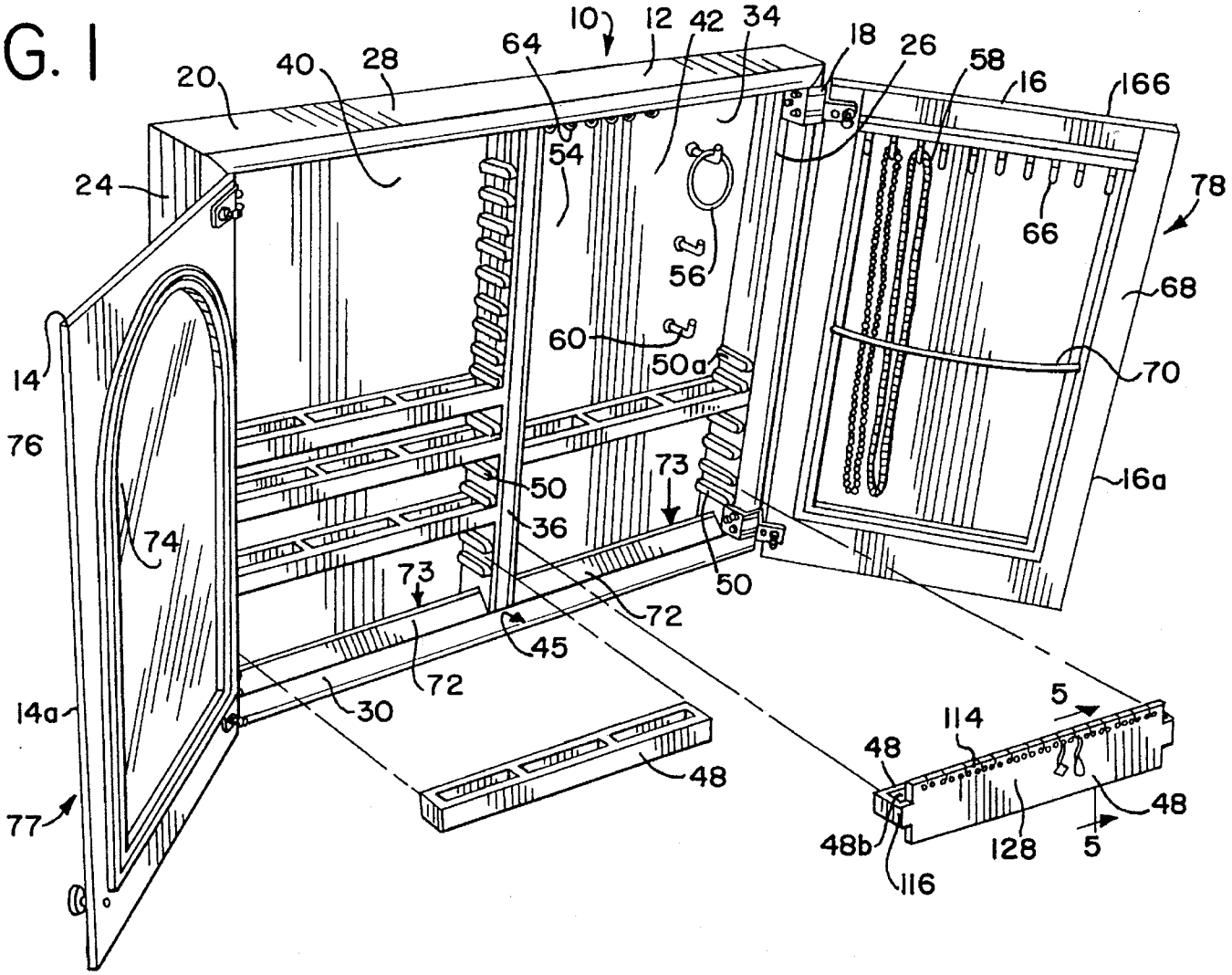
FIG. 1 is a front perspective elevational view of the jewelry cabinet of the present invention in an open position and partially exploded to show the arrangement of the shelving units forming part of the invention.

Referring now to FIG. 1, a preferred embodiment of the jewelry cabinet of the present invention is generally indicated at 10 and is shown in the open position. The cabinet 10 includes a housing 12 to which is attached a left door 14 and a right door 16. The left and right doors 14, 16 are pivotally attached to the housing 12 by hinges 18. The hinges 18 preferably are of the type which removably clasp the doors 14, 16 in the closed position.

The housing is formed by a peripheral wall 20, which extend around the perimeter. Forming the wall 20 is a generally vertically upright left sidewall 24 and right sidewall 26. The peripheral wall 20 also includes a top sidewall 28 and a bottom sidewall 30 which are connected to and extend between the left and right sidewalls 24, 26. The housing 12 also includes a planar rear wall 34 which is connected to the peripheral wall 20 about the length of the wall.

A separating wall 36 extends generally vertically upward from the bottom sidewall 30 to the top sidewall 28. A left compartment 40 is formed within the housing by the peripheral sidewall 20, separating wall 36 and rear wall 34.

Similarly, a right compartment 42 is formed by the peripheral wall 20, separating wall 36 and rear wall 34. Preferably, the left compartment 40 and right compartment 42 are equally sized by placing the separating wall 36 midway between the left sidewall 24 and right sidewall 26.

The doors 14, 16 are sized to selectively close and open the compartments. For example, the left door 14 is sized so that when the door is pivoted into the closed position, an inner edge 14*a* of the door is vertically aligned with the separating wall 36. Similarly, the right door 16 is sized so that when the right door is pivoted into the closed position, the inner edge 16*a* of the right door is vertically aligned with the separating wall 36. The depth of the separating wall 36 is less than the depth of the peripheral wall 20 to form a gap 45 between the separating wall 36 and the doors 14, 16 when the doors are closed.

To store small items of jewelry such as earrings 46, the left sidewall 24, right sidewall 26 and middle wall 36 are configured to removably support a plurality of shelving units or shelves 48 in a vertical arrangement, as shown in FIG. 1. More particularly, the right sidewall 26 includes a plurality of vertically spaced elongated supports 50. The left sidewall 24 also includes a plurality of the supports 50 arranged so as to be vertically spaced along the height of the sidewall. The middle wall 36 includes the elongated supports 50 with the elongated supports arranged so as to be horizontally aligned with the supports 50 on the left sidewall 24 and right sidewall 26. Thus, when shelves 48 are inserted between the supports 50 so that they are removably retained by the supports 50, the shelves are supported in a horizontal position.

As many users of jewelry cabinets have a large number of jewelry items which are best retained in shelving units, the left sidewall 24 and facing surface of the middle wall 36 includes supports 50 which are vertically separated for approximately the total height of the left compartment 40. In contrast, in the right compartment 42, the supports 50 are vertically spaced along the lower portion of the compartment. The upper supports 50*a* in the right compartment are spaced from the top sidewall 28 to form an upper display space 54 for the storage and display of bracelets 56 and necklaces 58.

The bracelets 56 are stored and displayed on a series of hooks 60. As the width of the bracelets 56 is less than the height of the display space 54, the hooks 60 are vertically aligned so that the bracelets may be displayed in a vertically aligned relationship for space efficiency. To store and display necklaces 58 in the display space 54, a series of hooks 64 are attached to the rear wall 34 and are horizontally aligned. The hooks 64 are aligned in close proximity to the top sidewall 28 so that the display space 54 may accommodate long necklaces. Also, to group the necklaces 58 together, the bracelet hooks 60 are vertically aligned toward one side of the display space and preferably proximate the right sidewall 26. The necklaces 58 are then hung to the left of the bracelets 56

To store and display necklaces 58 and in particularly necklaces having lengths which present difficulty in storing in the display space 54, a series of hooks 66 are attached to the right door 16 along an interior surface 68 of the right door. To present an orderly appearance and accommodate necklaces having long lengths, the hooks 66 are preferably attached to the right door 16 proximate the upper edge 16*b* of the door and arranged in a horizontally aligned position.

It may be seen that when opening the right door 16, the necklaces may swing out causing one or more of the necklaces to fall off the hooks 66. Therefore, to prevent this swinging, a restraining chord 70 is attached to the interior surface 68. The card 70 extends horizontally across the right door 16 and below the hooks 66. The card 70 is preferably elastic to facilitate the insertion and removal of the necklaces.

For the storage of small items, the housing includes a retaining wall 72 which extends along the bottom sidewall 30 in each compartment 40, 42. Between the retaining wall 72 and rear wall 34, a trough 73 is formed for jewelry. The cabinet 10 is preferably mounted so the user may see in the trough 73 when the doors 14, 16 are opened.

To allow the user to examine their appearance while selecting jewelry, a mirror 74 is attached to the interior surface 76 of the left door 14. Thus, the mirror 74 is usable when both the doors 14, 16 are in the open position. The mirror 74 may be configured to present a pleasing appearance and need not cover the entire interior surface 76. In fact, it is preferable to cover only a portion of the surface 76.

Figure 2:
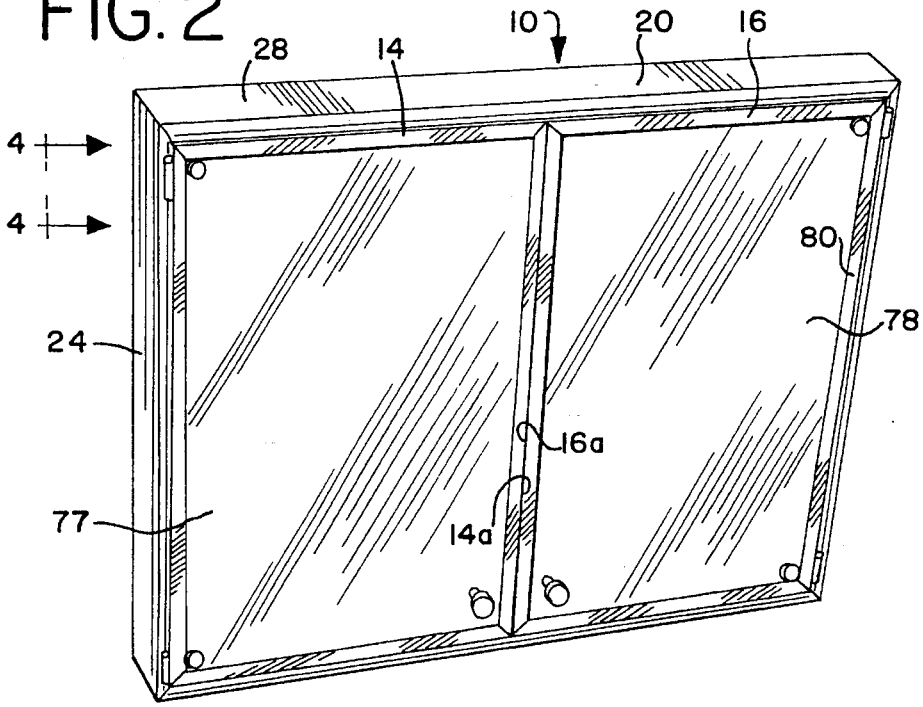
FIG. 2 is a front elevational view of the jewelry cabinet of FIG. 1 shown in a closed position.

Referring to FIG. 2, the cabinet 10 is shown in the closed position, with the left door 14 closing the left compartment 40 and the right door 16 closing the right compartment 42. To allow the user to view their appearance, at least a portion and preferably the entire exterior surface 77 of the left door 14 and the exterior surface 78 of the right door 16 is mirrored. Preferably, the both left door 14 and the right door 16 are mirrored; however, it is also contemplated that only one of the doors is mirrored. Edges 80 of the doors 14, 16 may be beveled for appearance. Also, to completely close the cabinet 10, the left door 14 and the right door 15 are sized so that the inner edge of 14*a* of the left door and inner edge 16*a* of the right door are closely proximate to each other, when the doors are in the closed position.

Figure 3:
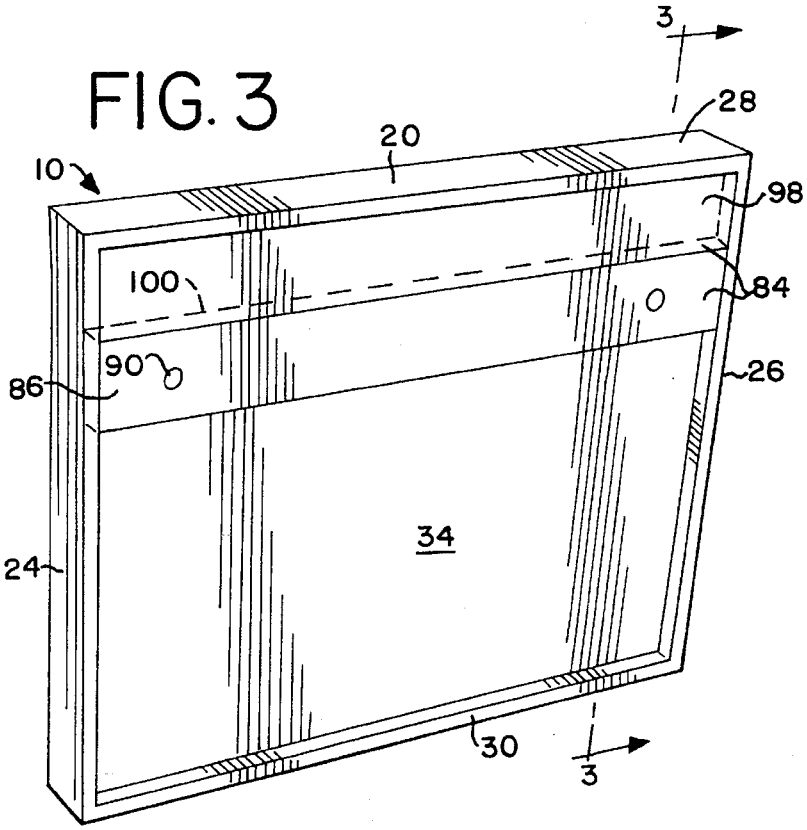
FIG. 3 is a rear elevational view of the jewelry cabinet of FIG. 2.
Figure 4:
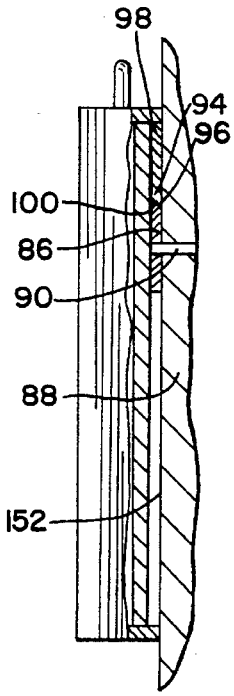
FIG. 4 is a partial section view taken along the line 4—4 of FIG. 2 and in the direction generally indicated.

Referring to FIGS. 3 and 4, an arrangement 84 for removably mounting the cabinet 10 to a wall or other vertically flat surface is shown. The mounting arrangement 84 includes a generally flat board 86 which is attached in a horizontal relationship to a vertical support 88 by fastening items 90 such as nails, screws or the like. A top edge 94 of the board 86 is angled upward and outward away from the support 88 to form a notch 96. The housing 12 includes a hanging board 98 attached to and extending horizontally along the rear wall 34. The board 98 has a lower edge 100 which is configured to slip within the notch 96 to hang the cabinet 10 from the vertical support 88.

Figure 5:
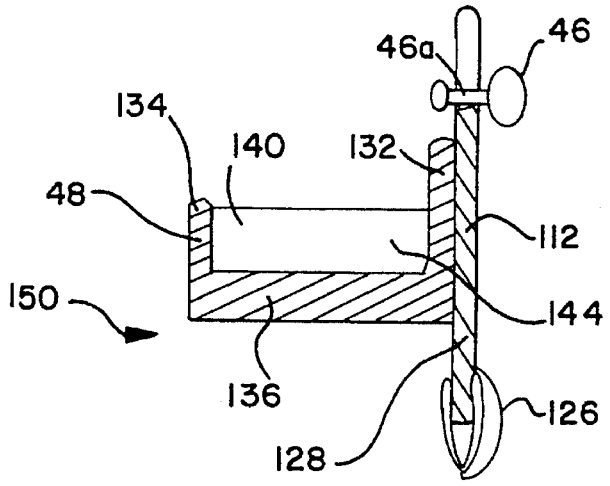
FIG. 5 is a sectional view of an earring shelving unit forming part of the invention and taken along the lines 5—5 in FIG. 1 and in the direction generally indicated.
Figure 6:
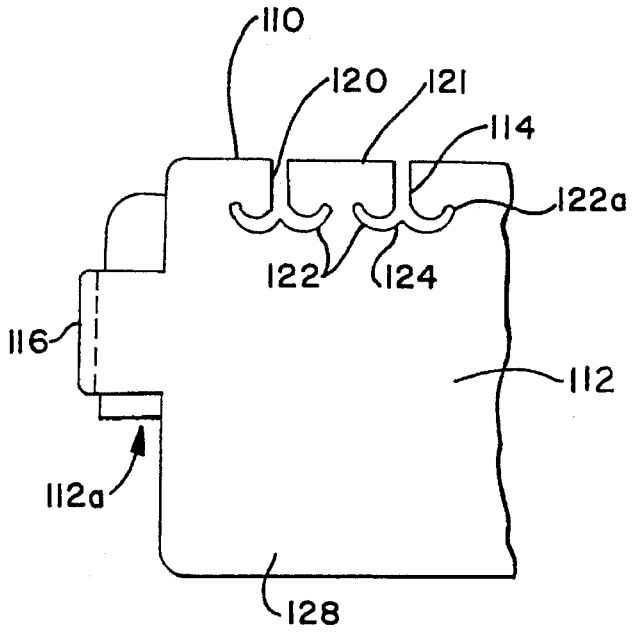
FIG. 6 is a front elevational view of the earring shelving unit.

Referring to FIGS. 5 and 6 in conjunction with FIG. 1, a display unit 110 particularly configured for the display and storage of earrings 46 and the like may be removably retained within the housing 12. The shelf 110 includes a frontal, vertically extending slat 112. Formed in the slat 112 are a series of notches 114 which are uniquely configured to store and display the different types of earrings 46. Attached to the lateral ends 112*a* of the slat 112 are bracket arms 116 configured to fit between the supports 50 so that the individual display unit 110 may be removably retained within the housing 12.

Referring to FIG. 6, more particularly in the orientation shown, the notches 114 are particularly adapted to post and wire earrings and are generally configured in the form of a "ᒧ". The notches 114 include a slot 120 which extends downward from a longitudinal edge 121. At the base of the slot 120, two opposing branch slots 122 curve outward and upward with an upward peak 124 formed between the slots 122. A pair of earrings 46 such as post or wire earrings may then be stored and displayed with one of the earrings in each branch and the post 46*b* (FIG. 5) extending through the branch slot 122 and the peak 124 separating the earrings. Clip earrings 126 may be clipped to a longitudinal edge portion 128 opposite the notches 114.

When the display unit 110 is rotated so that the notches 114 extend along the lower edge portion, the configuration of the notches is uniquely configured for the storage and display of hoop earrings. The hoop earrings are slipped into the branch notches 122 via the slot 120, and each of the hoop earrings are retained in the outer ends 122*a* of the branch slots 122. Clip earrings 126 may also be clipped to the opposing longitudinal edge portion 128.

Referring to FIGS. 5 and 6, the shelving units 48 have a vertically extending frontal wall 132 separated from a vertically extending rear wall 134 by a horizontal floor 136. The frontal wall 132, rear wall 134 and floor 136 form a well 140 to retain and store jewelry items. Bordering walls 144 may form multiple wells 140 in a storage unit 48 with the bordering walls at the lateral edges of the unit 48 configured to slide between and be removably held by the supports 50.

The display unit 110 and shelving unit 48 are also sized so that the bracket arms 116 of the display unit may fictionally engage the lateral edges 48*b* of the shelving unit to form an earring storage and display shelf 150. The shelf 150 may then be removably stored in the housing 12 by being inserted between the supports. Also it should be recognized that the display unit may be fitted to the shelving unit 48 whether the display unit is oriented so that the notches 114 are at the upper edge of the shelving unit or at the lower edge.

The display unit 110 and shelving unit 48 are preferably constructed of a plastic underlayer with a flock outer covering. The housing 12 is preferably made of wood with the surface of the compartments 40, 42 covered with matching flock 152 (FIG. 4). The interior surfaces of the doors are preferably covered with the flock also.

A specific embodiment of the novel cabinet for the storage and display of jewelry according to the present invention has been described for the purposes of illustrating the manner in which the invention may be made and used. It should be understood that implementation of other variations and modifications of the invention in its carious aspects will be apparent to those skilled the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A cabinet for the storage and display of jewelry comprising:

a generally rectangular housing having a first generally vertically extending sidewall, a second generally vertically extending sidewall, a top sidewall and a bottom sidewall, all the sidewalls being connected to each other to form a peripheral wall having interior and exterior side surfaces, a rear planar wall connected to and extending between said sidewalls, a generally vertically extending middle wall having opposite side surfaces between first and second sidewalls to form a first compartment and a second compartment within said housing;

a first door pivotally connected to said housing and adapted to pivotally close said first compartment and a second door to pivotally close said second compartment, at least one of said first door and second door having a mirror extending over at least a portion of an exterior surface, a plurality of first hanging hooks to retain necklaces arranged on an interior surface of at least one of said first and second doors; and a plurality of horizontally extending shelves configured to fit within at least one of said compartments, said shelves including a generally horizontally extending strip for supporting jewelry, at least one of said shelves including a frontal vertical strip having upper and lower edges and opposite side edges, said frontal vertical strip attached to said horizontal strip, said vertical strip including a plurality of slots disposed along said upper edge for retaining earrings, said middle wall and said first and second sidewalls adapted to removably hold said shelves in a vertically separated arrangement, said middle wall including a plurality of vertically spaced elongated supports on both opposite side surfaces and said first and second sidewalls including vertically spaced elongated supports on said interior side surface of said peripheral wall, said elongated supports horizontally aligned with said elongated supports on said middle wall to removably hold said shelves in a horizontal position.

2. The jewelry cabinet of claim 1 wherein said middle wall and one of said first and said second sidewall being adapted to removably hold said shelves to form a display spacing between said shelves and one of said top and bottom sidewalls, and a plurality of hanging hooks for displaying bracelets being attached to said rear wall and disposed within said display spacing.

3. The jewelry cabinet of claim 2 wherein said hanging hooks for displaying bracelets are vertically aligned.

4. The jewelry cabinet of claim 1 including a plurality of second necklace display hooks attached to said rear wall and within said display spacing.

5. The jewelry cabinet of claim 1 including a mirror disposed on an interior surface of the other of said first and said second doors.

6. The jewelry cabinet of claim 1 including a necklace swinging restraining means disposed on said at least one of said first and second doors below said first hanging hooks to retain necklaces.

7. The jewelry cabinet of claim 1 wherein both of said first and second doors include mirrored exterior surfaces.

8. The jewelry cabinet of claim 1 wherein said shelves are adapted to form wells to retain jewelry.

* * * * *